US006949052B2

(12) United States Patent
Millington et al.

(10) Patent No.: US 6,949,052 B2
(45) Date of Patent: Sep. 27, 2005

(54) EXERCISE EQUIPMENT LOCATOR

(76) Inventors: Peter Millington, 170 Marlborough Ave., Apt. #2, Boston, MA (US) 02116; Ralph Galetti, 5800 Nugget NE., Albuquerque, NM (US) 87111

( * ) Notice: Subject to any disclaimer, the term of this patent is extended or adjusted under 35 U.S.C. 154(b) by 444 days.

(21) Appl. No.: 09/994,243

(22) Filed: Nov. 27, 2001

(65) Prior Publication Data

US 2003/0100406 A1 May 29, 2003

(51) Int. Cl.[7] ..... A63B 21/00
(52) U.S. Cl. ..... 482/8; 482/1; 482/900
(58) Field of Search ..... 482/1–9, 900–902, 482/51, 54

(56) References Cited

U.S. PATENT DOCUMENTS

| | | | |
|---|---|---|---|
| 4,101,873 | A | 7/1978 | Anderson et al. |
| 4,173,035 | A | 10/1979 | Hoyt |
| 4,361,324 | A | 11/1982 | Baroi |
| 4,421,319 | A | 12/1983 | Murphy |
| 4,476,469 | A | 10/1984 | Lander |
| 4,507,653 | A | 3/1985 | Bayer |
| 4,554,419 | A | 11/1985 | King et al. |
| 4,660,039 | A | 4/1987 | Barricks et al. |
| 4,751,440 | A | 6/1988 | Dang |
| 4,961,575 | A | 10/1990 | Perry |
| 5,132,622 | A | 7/1992 | Valentino |
| 5,204,657 | A | 4/1993 | Prosser et al. |
| 5,250,014 | A | 10/1993 | Chang |
| 5,293,635 | A | 3/1994 | Faulk, Jr. et al. |
| 5,294,915 | A | 3/1994 | Owen |

(Continued)

OTHER PUBLICATIONS www.jtech.com/products/guest–alert.htm, Guest Alert Paging Systems, Nov. 7, 2000, pp. 1–3.
www.jtech.com/products/people–alert.htm, PeopleAlert, Nov. 7, 2000, pp. 1–2.
www.zoomcomm.com/other.htm, Nov. 7, 2000, 1 page.

*Primary Examiner*—Glenn E. Richman

(74) *Attorney, Agent, or Firm*—Wolf, Greenfield Sacks, P.C.

(57) ABSTRACT

The present invention is directed to devices, systems, and methods for intelligent or 'smart' exercise equipment to indicate the location, the intent to use, and/or the amount and/or type of use of a piece of exercise equipment. More specifically, one embodiment of the invention may be used to locate or indicate the location of a portable piece of exercise equipment. Such an indicator may also indicate to other users, a particular user's intent to use the piece of equipment such that other users will not attempt to use the equipment or the current user may end their use of the equipment and pass it to the intended user. In a further embodiment, the indicator may not be activated if the piece of exercise equipment is already in use by a current user. In another embodiment of the invention, the amount of use of, e.g., repetitions done on, a piece of exercise equipment may be indicated to the user or may be logged for later viewing, downloading, or transmission. Similarly, another embodiment of the invention may determine, indicate, store, display, download, and/or transmit the type of exercise done on a piece of equipment. Any of the above embodiments may include electronic devices or systems mounted in or on the exercise equipment itself. Those systems and/or devices may be rechargeable at a recharging unit within the mounting location for that piece of equipment.

47 Claims, 12 Drawing Sheets

U.S. PATENT DOCUMENTS 5,370,387 A 12/1994 Baker
5,394,879 A 3/1995 Gorman
5,517,494 A 5/1996 Green
5,538,007 A 7/1996 Gorman
5,559,681 A 9/1996 Duarte
5,598,143 A 1/1997 Wentz
5,785,632 A 7/1998 Greenberg et al.
5,859,585 A 1/1999 Fleming
6,014,078 A 1/2000 Rojas et al.
6,039,679 A 3/2000 Yu
6,066,161 A 5/2000 Parella
6,126,303 A 10/2000 Gross
6,132,345 A 10/2000 Beierschmitt et al.
6,458,060 B1 * 10/2002 Watterson et al. ..... 482/54
6,475,115 B1 * 11/2002 Candito et al. ..... 482/4
6,656,091 B1 * 12/2003 Abelbeck et al. ..... 482/9

* cited by examiner 12
12
12

Fig. 7B

| Exercise Equipment Identifier 86 | Address Code 62 | | | | |
|---|---|---|---|---|---|
| 5 | 0 | 0 | 0 | 0 | 0 |
| 10 | 0 | 0 | 0 | 0 | 1 |
| 15 | 0 | 0 | 0 | 1 | 0 |
| 20 | 0 | 0 | 0 | 1 | 1 |
| ... | ... | ... | ... | ... | ... |

84

Fig. 8

| TIME (SEC) | LED 1 ON | LED 2 ON | LED 3 ON | LED 4 ON | LED 5 ON | LED 6 ON |
|---|---|---|---|---|---|---|
| .05 | X | | X | | X | |
| .1 | X | | X | | X | |
| .15 | X | X | X | X | X | X |
| .2 | X | X | X | X | X | X |
| .25 | X | X | X | X | X | X |
| .3 | X | X | X | X | X | X |
| .35 | | X | | X | | X |
| .4 | | X | | X | | X |
| .45 | | X | | X | | X |
| .5 | | X | | X | | X |
| .55 | X | X | X | X | X | X |
| .6 | X | | X | | X | |
| .65 | X | | X | | X | |
| .7 | X | | X | | X | |
| .75 | X | X | X | X | X | X |
| .8 | | X | | X | | X |
| .85 | | X | | X | | X |
| .9 | | X | | X | | X |
| .95 | X | X | X | X | X | X |
| 1.0 | X | | X | | X | |
| 1.05 | X | | X | | X | |
| 1.1 | X | X | X | X | X | X |
| 1.15 | | X | | X | | X |
| ... | ... | ... | ... | ... | ... | ... |

| Weight Identifier 86 | Date/Time of Use 124 | Number of Times Used 120 | Number of Repetitions 122 | Total Time Used (minutes/use) 126 | Type of Exercise 130 |
|---|---|---|---|---|---|
| 5 | 01-01-01/1200 | 1 | 30 | 20 | curl |
| 10 | 01-01-01/0600 | 3 | 30 | 30 | curl |
| 10 | 01-02-01/1800 | 1 | 15 | 10 | press |
| 20 | 01-02-01/0645 | 6 | 60 | 25 | curl |
| ... | ... | ... | ... | ... | ... |

| User Identifier 112 | Workout Identifier 128 | Weight Identifier 86 | Date/Time of Use 124 | Number of Times Used 120 | Number of Repetitions 122 | Type of Exercise 130 | Total Time Used (minutes/day) 126 |
|---|---|---|---|---|---|---|---|
| 036 | 0 | 0 | 0 | 0 | 0 | 0 | 0 |
| 049 | 1 | 15 | 01-01-01/0600 | 3 | 15 | press | 20 |
| 049 | 2 | 20 | 01-01-01/0620 | 3 | 30 | curl | 30 |
| 049 | 3 | 20 | 01-02-01/0600 | 3 | 30 | curl | 20 |
| 105 | 1 | 40 | 01-01-01/1800 | 3 | 30 | curl | 20 |
| 105 | 2 | 40 | 01-02-01/1800 | 3 | 30 | curl | 20 |
| 146 | 1 | 35 | 01-02-01/1200 | 6 | 60 | curl | 30 |
| ... | ... | ... | ... | ... | ... | ... | ... |

EXERCISE EQUIPMENT LOCATOR

FIELD OF THE INVENTION

The present invention relates to indicating devices and systems and more particularly, to devices and systems to indicate the location, an intent to use, and/or the amount and/or type of use of a piece of exercise equipment such as a hand weight or dumbbell.

BACKGROUND OF THE INVENTION

Exercise equipment, specifically free weights and hand held weights, are typically inert and do not interact with their environment or users. Hand held weights and free weights are usually stored in racks, such that if stored correctly, the weights of the proper mass may be easily found and retrieved for different exercise regimes. In a typical health club setting, users of the weights are expected to return the weights to their proper weight position in the rack. If the weights are not in position, there is no indication if the weights are in use or merely not returned to their proper place in the storage racks. As a result, current exercise equipment designs do not facilitate use by a large amount of people at a health club or a gym setting.

SUMMARY OF THE INVENTION

In one embodiment of the invention, a system for locating portable exercise equipment is shown. The system includes a portable exercise device and an indicator mounted to the exercise device. The device further comprises a transmitter remotely location from the exercise device and adapted to send an actuation signal. A receiver assembly having an output is mounted to the exercise device and is responsive to the actuation signal. A controller is responsive to the output of the receiver assembly such that the indicator is initiated when the receiver assembly receives the actuation signal. The system further comprises a power unit mounted to the exercise device and is electrically coupled to the receiver assembly, the controller, and the indicator.

In another embodiment of the invention, a system for recharging exercise equipment having an electronic device and a rechargeable power unit is shown. The system comprises a storage rack having a storage mount adapted to store the exercise device. The system further comprises a recharging unit mounted to the storage rack in the storage mount.

In yet another embodiment of the invention, a system for indicating use of exercise equipment is shown. The system comprises a portable exercise device, an in-use sensor mounted to the exercise device and having an output, and a controller responsive to the output of the in-use sensor such that the controller determines when the exercise device is in-use by a user.

In one embodiment of the invention, a system for tracking exercise completed by a user is shown. The system comprises a piece of exercise equipment, a device adapted to communicate a unique identification signal, the identification signal correlated to a particular user of the exercise equipment, and an in-use sensor mounted to each piece of equipment, the in-use sensor having an output. the system further comprises a controller mounted to each piece of equipment and responsive to the identification signal and the output of the in-use sensor, wherein the controller records the use of the exercise equipment associated with the user identification signal.

In another embodiment of the invention, a system for locating exercise equipment is shown. The system comprises a plurality of exercise equipment and an indicator mounted to each piece of equipment. the system further comprises a transmitter adapted to send a plurality of actuation signals, each actuation signal correlated to a piece of exercise equipment. A receiver mounted to each piece of equipment is adapted to receive the plurality of actuation signals and has an output. The system further comprises a controller mounted to each piece of equipment and responsive to the output of the receiver such that the indicator is initiated when the receiver receives the correlated actuation signal for that piece of equipment.

In yet another embodiment of the invention, a system for locating an item which is lost and not in use is shown. The system comprises a transmitter adapted to send an electromagnetic actuation signal. A receiver is mounted to an item, the receiver adapted to receive the actuation signal and has a first output. The system further comprises means for detecting use of the item having a second output, an indicator mounted to the item, and a controller responsive tot he first output of the receiver and the second output of the means for detecting, such tat the indicator is initiated when the receiver receives the actuation signal and the item is not in use.

In one embodiment of the invention, a method for locating a piece of exercise equipment is shown. The method includes the steps of initiating a transmitter to locate a particular piece of equipment, selecting an actuation code correlated to the particular piece of equipment, encoding the actuation signal, and transmitting the actuation signal. The method further comprises the steps of receiving the actuation signal at the equipment, decoding the actuation signal to determine the actuation code, comparing the actuation code with a device identifier and initiating an indicator when the actuation code matches the device identifier.

BRIEF DESCRIPTION OF THE DRAWINGS

Various embodiments of the invention will now be described, by way of example, with reference to the accompanying drawings, in which:

FIG. 7B is a diagram of an exemplary table for a data base of equipment transmission address codes according to an embodiment of the invention;

FIG. 8 is a diagram of an exemplary initiation timing format for an indicator device in one embodiment of the invention;

DETAILED DESCRIPTION

Figure 1A:
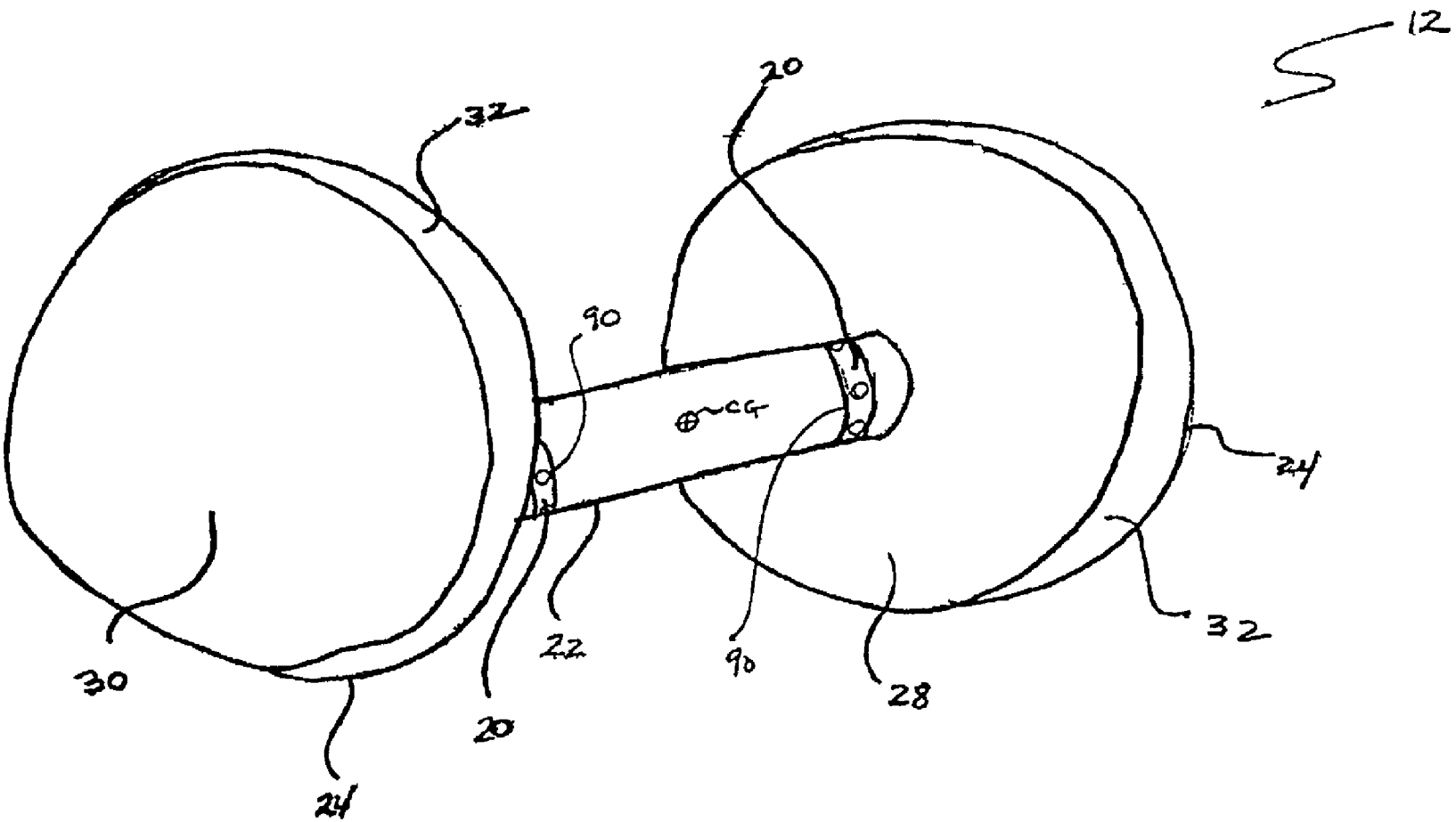
FIG. 1A is a perspective view of a piece of exercise equipment, such as a hand held weight, according to one embodiment of the invention.

The present invention is directed to devices, systems, and methods for intelligent or 'smart' exercise equipment to indicate the location, the intent to use, and/or the amount and/or type of use of a piece of exercise equipment. More specifically, one embodiment of the invention may be used to locate or indicate the location of a portable piece of exercise equipment. Such an indicator may also indicate to other users, a particular user's intent to use the piece of equipment such that other users will not attempt to use the equipment or the current user may end their use of the equipment and pass it to the intended user. In a further embodiment, the indicator may not be activated if the piece of exercise equipment is already in use by a current user. In another embodiment of the invention, the amount of use of, e.g., repetitions done on, a piece of exercise equipment may be indicated to the user or may be logged for later viewing, downloading, or transmission. Similarly, another embodiment of the invention may determine, indicate, store, display, download, and/or transmit the type of exercise done on a piece of equipment. Any of the above embodiments may include electronic devices or systems mounted in or on the exercise equipment itself. Those systems and/or devices may be rechargeable at a recharging unit within the mounting location for that piece of equipment.

In one illustrative embodiment of the invention, a system for locating or indicating an intent to use portable exercise equipment 10 is shown in FIGS. 1A–10. The system includes in its general organization at least one piece, and preferably a plurality of pieces, of exercise equipment 12, a receiver assembly 14 and an indicator device 20 mounted to each portable piece of exercise equipment shown in FIGS. 1A and 1B, a transmitter assembly 16 remotely located from the exercise equipment shown in FIG. 3, and optionally a storage device 18 to store the exercise equipment shown in FIG. 2. Preferably, the portable exercise equipment is a hand weight or dumbbell and the storage device is a rack, although those skilled in the art will recognize that many other types of portable exercise equipment, such as free weights, and storage devices would be appropriate for the present invention.

Figure 1B:
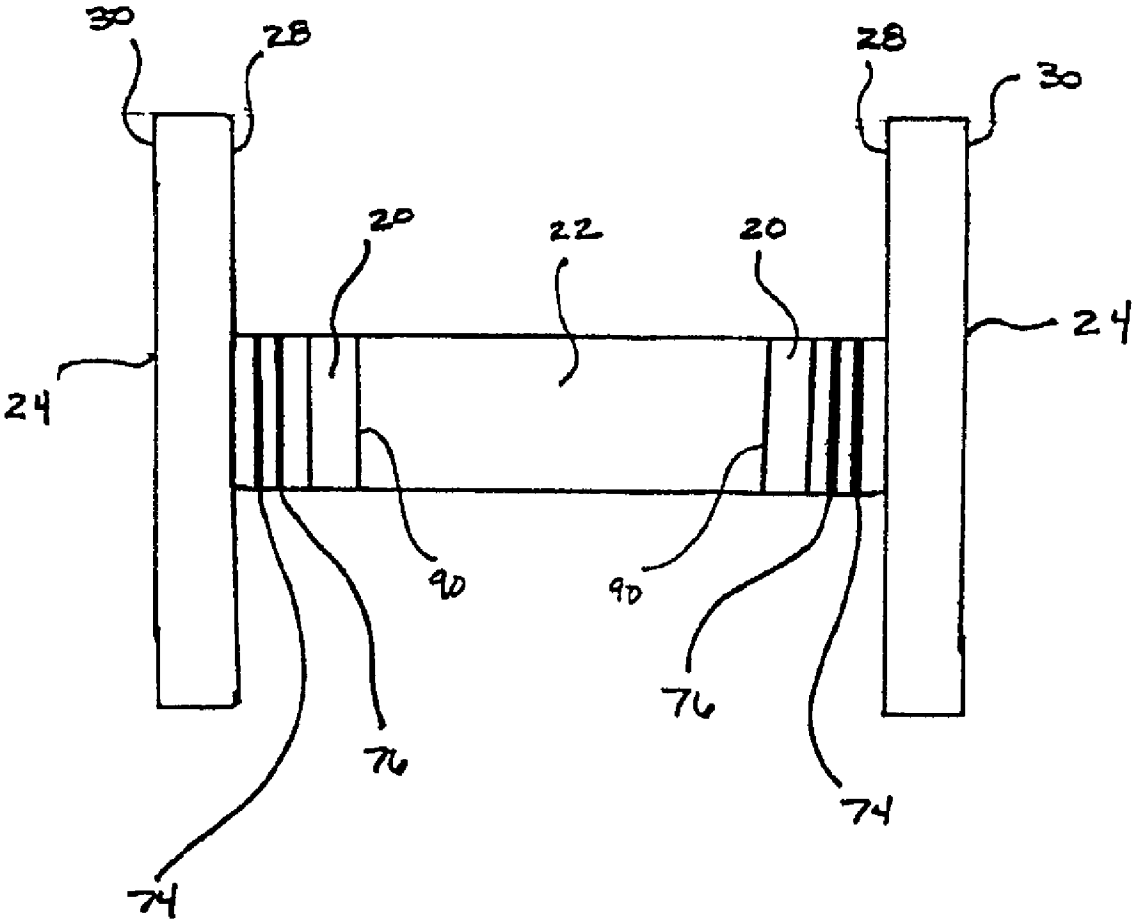
FIG. 1B is a side view of a hand held weight of a further embodiment of the invention.
Figure 4:
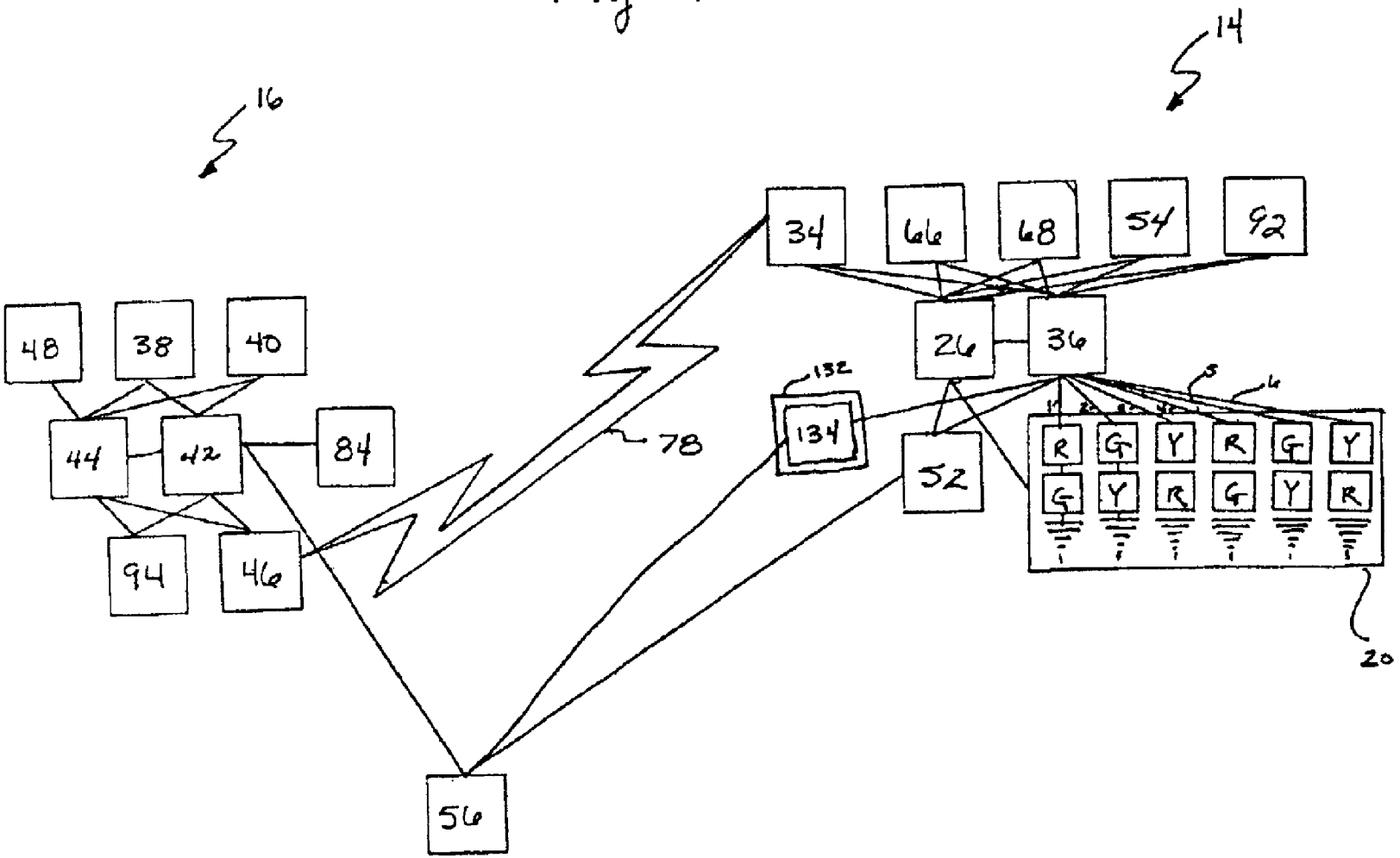
FIG. 4 is a schematic diagram view of a transmitter assembly and a receiver assembly according to an embodiment of the invention.

In operation, a first user of a particular dumbbell 12 shown in FIGS. 1A and 1B may remove the dumbbell from the rack 18, shown in FIG. 4, to a different area of the exercise room, such as a gym or fitness center. A second user may approach the rack and intend to use the same particular weight of dumbbell, however, that dumbbell is no longer stored in its proper mount 50 in the rack. Either the dumbbell is still in use by the first user or the first user failed to return the dumbbell to the rack or place it in the appropriate mount in the rack. Thus, the second user may locate the desired dumbbell by activating a unique transmitter signal in the transmitter assembly 16 for that particular dumbbell. The unique signal is then received by the dumbbell receiver assembly 14. The dumbbell receiver assembly 14 then initiates an indicator device 20 to indicate to the second user the location of the dumbbell. The indicator device 20 may also indicate to other potential users or the current user of the weight that the second user intends to use that dumbbell.

Figure 6:
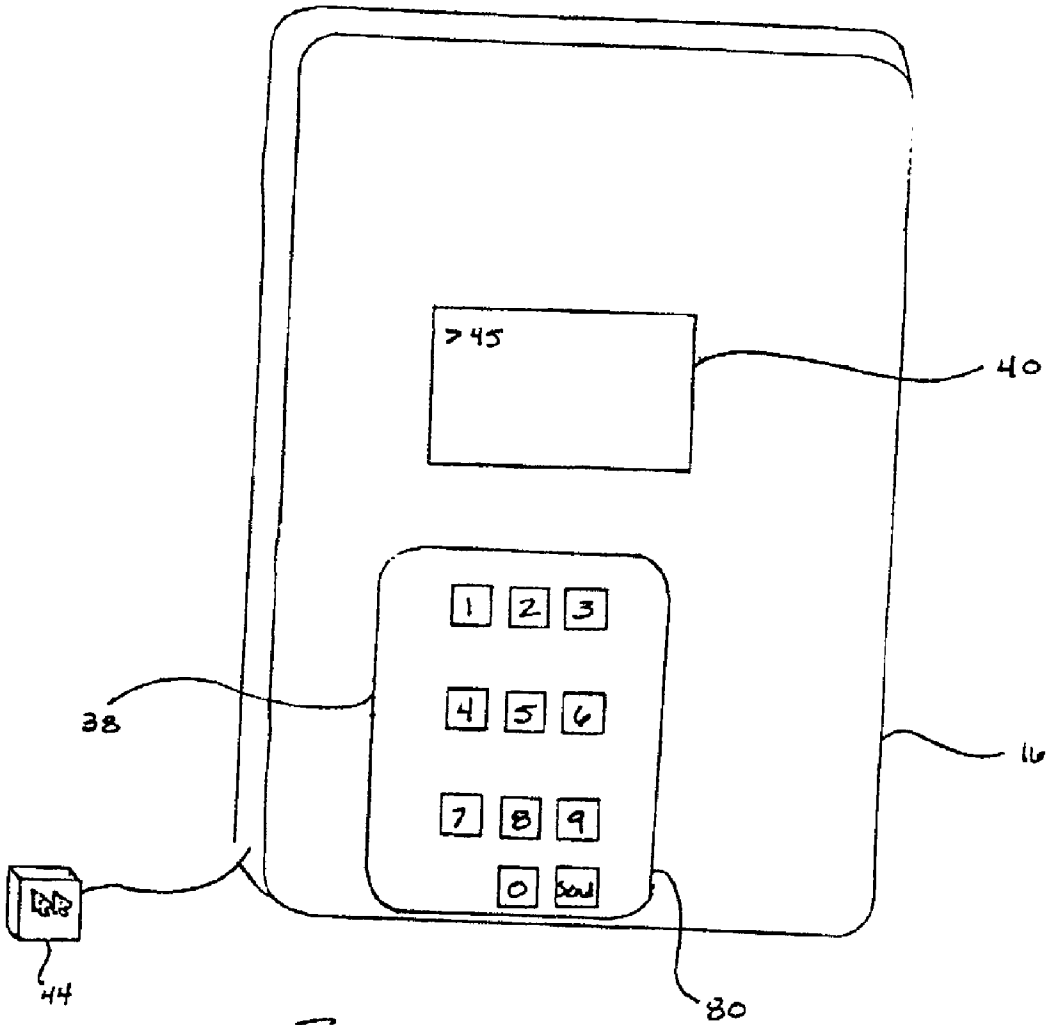
FIG. 6 is a perspective view of a stand-alone transmitter assembly according to another embodiment of the invention.

The transmitter assembly 16 is remotely located from the dumbbell receiver assembly 14 and may be mounted in a stand-alone system or may be integrated into the body of the storage rack 18 for the dumbbell(s). In one embodiment, as shown in FIG. 6, the transmitter assembly may be a stand-alone system that is preferably mounted to a wall of an exercise facility near the storage rack 18. A person wishing to locate a piece of exercise equipment may activate the transmitter assembly for a particular piece of equipment or set of equipment sharing certain characteristics. Those skilled in the art will recognize that many methods and devices are appropriate for initiating the transmitter assembly to locate a particular piece of exercise equipment.

In one embodiment shown in FIG. 6, the transmitter assembly 16 includes an input device 38 which may include a keyboard or keypad 80. A person wishing to locate a particular piece of equipment may type in the name or indicator for a piece of equipment. For example, if the user is looking for the 45 pound hand weights, the user may press 4 on the keyboard and then press 5 on the keyboard. An associated output device 40, such as a screen, may show the input name of the equipment. Example output devices connected to the transmitter assembly 16 include cathode ray tube displays, liquid crystal displays, and other video output devices, printers, and audio output. Example input devices 38 connected to the transmitter assembly 16 include keyboard, key pad, track ball, mouse, pen and tablet, communication devices, and data input devices such as audio and video capture devices. The invention is not limited to the particular input or output devices used in combination with the transmitter assembly 16 or to those described herein.

A controller 42 of the transmitter assembly 16 may recognize the input key sequence as the identifier that is associated with a particular piece or set of exercise equipment 12, such as a mass weight, name, or numerical identifier. The controller 42 may immediately initialize transmitting the unique signal appropriate for that equipment. Alternatively, the controller may require the user to press an enter key or transmit key before the transmitter assembly transmits a signal to the receiver assemblies on the exercise equipment.

Figure 2:
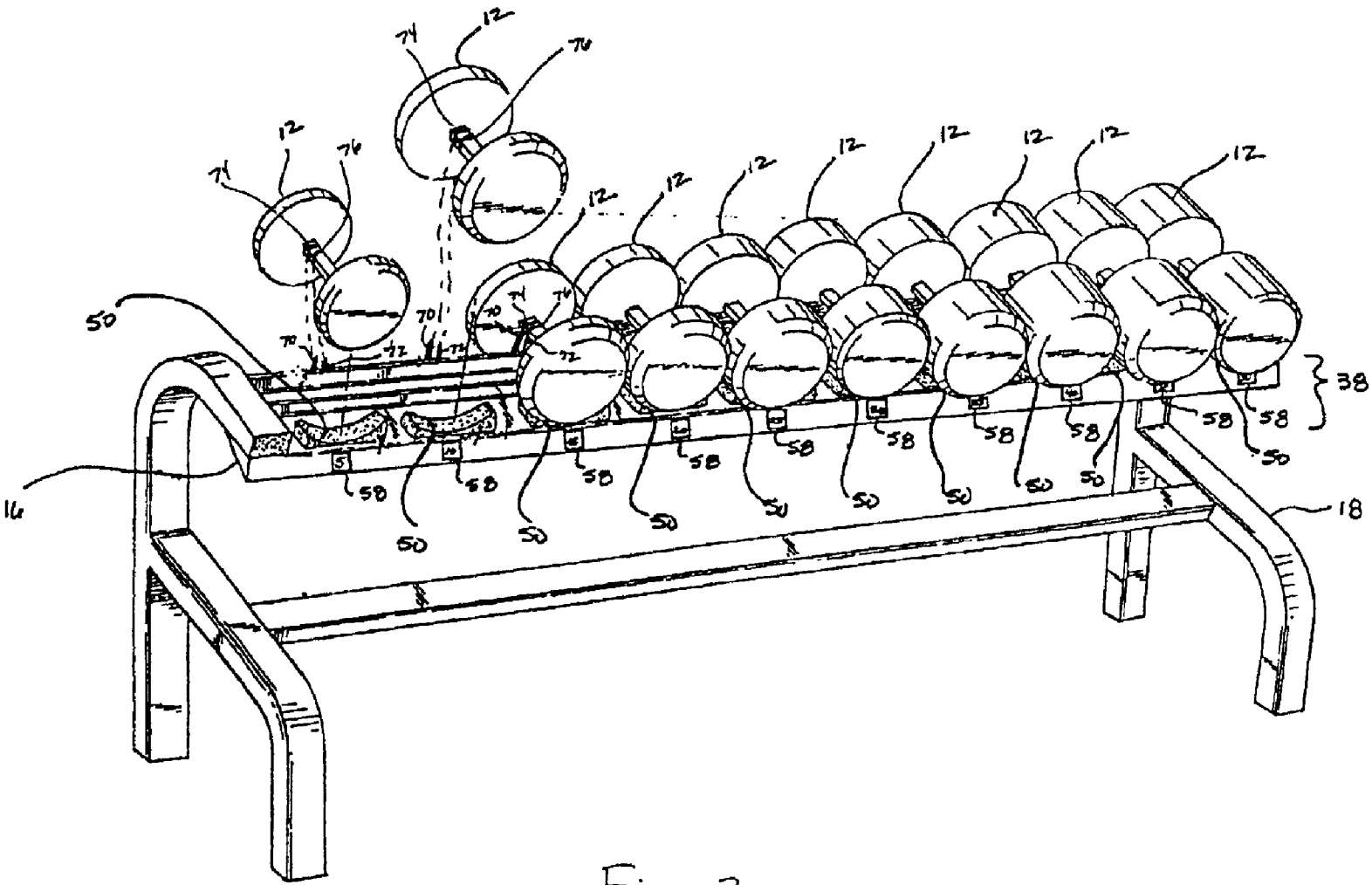
FIG. 2 is a perspective view of an embodiment of a storage rack for the hand held weight shown in FIG. 1B.

Alternatively, the input device 38 may include a plurality of switches or buttons 58, one button or switch 58 for each piece or set of equipment. The buttons/switches 58 may be located on a stand-alone panel, or as shown in FIG. 2, may be integrated into the storage rack 18 for the exercise equipment. The buttons/switches may be numbered to indicate the particular piece of exercise equipment, such as the mass weight of the piece of exercise equipment, and/or may be located at the proper storage mount 50 in the rack 18 for that particular piece of equipment. The transmitter assembly 16 may transmit the appropriate signal when the button is pushed or switch is flipped to the activate position. The transmitter assembly may transmit the signal sequence for the particular piece of exercise equipment until the pre-set signal sequence is complete. Alternatively, the transmitter assembly 16 may transmit the signal sequence for a particular piece of equipment as long as the button/switch is activated in the transmitter assembly.

The controller 42 and/or display device 40 may indicate to the user if there has been a successful transmission of the signal for a particular piece of exercise equipment. Additionally, the display device 40 may also indicate to the user any possible errors in the transmitter assembly, the receiver assembly, and/or the data input by the user including an unknown exercise equipment identifier.

The transmitter assembly 16 also includes a transmitter device 46 which may be co-located with the input device 38, or preferably, may be centrally located in the area of possible locations for the exercise equipment. In one embodiment of the invention shown in FIG. 3, the transmitter device 46 may be located on the ceiling proximate the center of the exercise room and may be connected to the remainder of the transmitter assembly 16 via a coaxial cable 82 or other appropriate communication device.

The transmitter assembly 16 may be powered from the same power source as the stand-alone locator panel 44 or may have an individual power source. Preferably, the power source may be from a standard outlet through a "blister" type power supply that plugs into a wall outlet. Those skilled in the art will recognize the power source 44 for the transmitter assembly may alternatively or additionally include batteries and solar power. Preferably, the transmitter 46 should provide about a 200 to 300 foot range in its signal transmission. The power of the transmitter should allow the proper range of the signal while remaining within FCC limitations.

For example, the transmitter 46 may be designed to transmit a bit stream actuation signal 78 over an electromagnetic frequency or plurality or range of electromagnetic frequencies. The one or plurality of frequencies carrying the bit stream code is transmitted by the transmitter 46 which is remotely located from the receiver assembly 14. The frequencies may be selected such that the receiver 34 will receive the transmitted actuation signal 78 even when a clear line of sight is not available between the remote transmitter assembly 16 and the receiver assembly 14. The actuation signal 78 is preferably transmitted over a frequency that does not require special licensing by the FCC. In one embodiment of the invention, the transmitter 46 may use a frequency of approximately 300 MHz and preferably 310 MHz. Those skilled in the art will realize that other frequency selections and ranges may also be appropriate, including 900–937 MHz ISM band, 2.5 GHz public band, and BlueTooth technology as well as other signal mediums including laser and infrared.

Figure 7A:
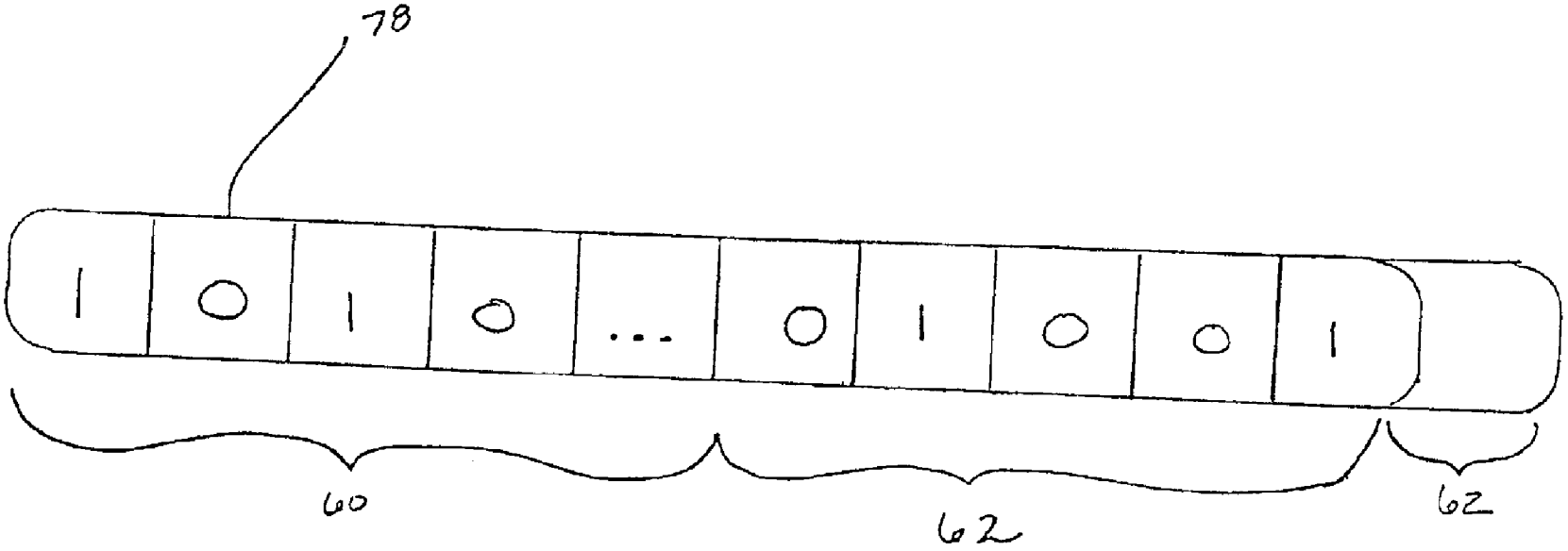
FIG. 7A is a diagram of an exemplary data format of an actuation signal sent by a transmitter assembly according to an embodiment of the invention.

The controller 42 of the remote transmitter assembly 16 may access a data base 84 of address codes 62 and determine and select which of the plurality of frequencies and/or unique bit stream address codes to transmit for the selected piece of exercise equipment 12. In one embodiment shown in FIG. 7A, the unique actuation signal 78 sent out over the appropriate frequency includes a synchronization bit stream 60, followed by at least one unique address code 62. Each unique bit stream address code 62 may identify a particular piece of exercise equipment or alternatively, each address code may identify a set of exercise equipment sharing a particular characteristic such as a mass weight. In one embodiment, each unique address code is assigned to a pair of hand weights with matching mass weights. The address code 62 may have 5-bits allowing 32 possible unique address codes. FIG. 7B illustrates an example table for an address code data base 84, which includes one or more records. In general, each record associates a weight identifier 86 with a unique address code 62.

The address code segment 62 is preferably included twice in each query transmission. Each receiver assembly 14 receives the signal 78 and may then verify that both received addresses are identical for error checking. If the two address codes 62 received do not match, the receiver assembly may ignore the query and wait for the next query transmission. The transmitter assembly 16 may retransmit each query twice in case of an error or interference of the transmission signal. Thus, each actuation signal 78 includes a total of three back-to-back query transmissions of the synchronization segment and two address segments.

Preferably, each receiver assembly will continuously receive every actuation signal transmission by the transmitter assembly 16 and will start decoding the address code after the synchronization and verification sequence. Once a receiver assembly has decoded the received address code, it compares the received address 62 with its own identifying address 64. If the received and identifying addresses match, the receiver assembly of that piece of equipment stops receiving the transmitted signal and initiates the indicator device 20. In one embodiment of the invention, the receiver assembly may not process any more received signals until the indicator device is no longer initiated.

To receive and decode the query transmission, the receiver assembly 14 includes a receiver 34, preferably wireless, and a micro-controller 36. Those skilled in the art will recognize that many known receivers and micro-controllers are appropriate for the present invention. The micro-controller 36 of each receiver assembly 14 may include a microchip PIC that is connected with and may be interfaced directly with the wireless receiver 34. The micro-controller will decode and compare the transmitted signal and device identifier, and then activate the appropriate indicator device.

A receiver assembly is mounted to each piece of portable exercise equipment 12. The dumbbell 12 of the preferred embodiment of the present invention, shown in FIGS. 1A and 1B, includes a hand grip 22 with identical weights 24 attached at either end of the grip. The weights 24 may be fixably mounted to the grip, and further, may be integrally formed with the grip. Alternatively, the weights may be removably attached to the grip such that the weights may be removed and exchanged for weights of a different mass or type. Connector devices (not shown) for removably attaching the weights to the bar are well known in the art and include cotter pins, pins, nuts, and tongue and groove systems.

Preferably the receiver assembly 14 is mounted to the grip 22 of the dumbbell 12 to maintain an even weight distribution about the center of gravity which is approximately located at the center of the grip 22, shown as CG in FIG. 1A. In one embodiment of the invention, the grip 22 is made of tubular metal or plastic with a hollow center, shown in the cross-sectional view of FIG. 5. The receiver assembly may be mounted inside the hollow grip approximately at the center of gravity CG, or center of the grip. Preferably, the weight of the receiver assembly and indicator device attached to each piece of exercise equipment is accounted for such that the given mass weight for a piece of equipment incorporates the weight of any additional devices required by the receiver assembly and/or the locator device.

Figure 5:
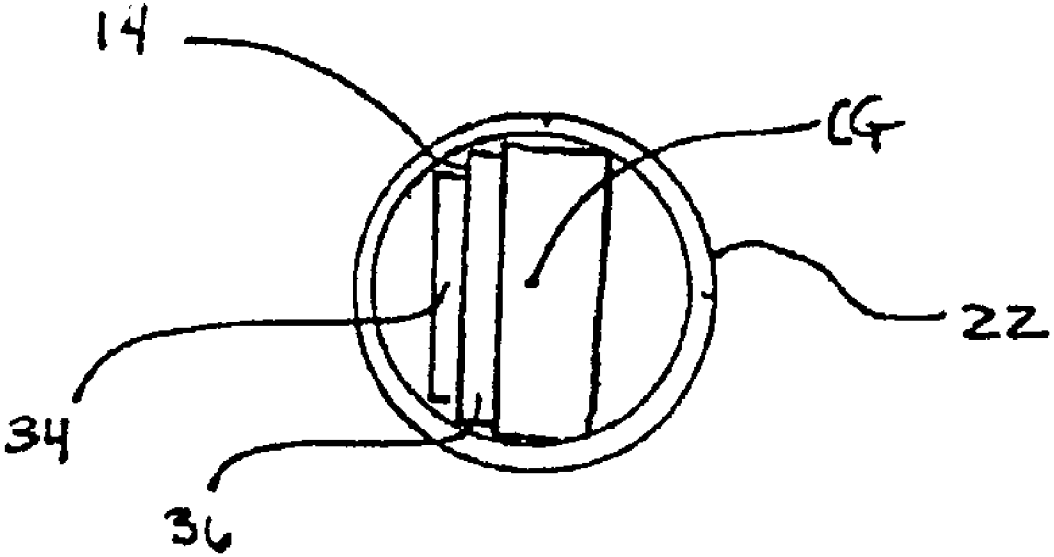
FIG. 5 is a cross-sectional view of the embodiment of the invention shown in FIG. 1A.

In one embodiment of the invention, the receiver assembly 14 may include an in-use sensor 66, shown in FIG. 5, to detect if that particular piece of exercise equipment is currently in use. Those skilled in the art will recognize that many in-use sensors may be appropriate to indicate use including, but not limited to, contact sensors, pressure sensors, accelerometers, inclinometers, and light sensors. Preferably, the in-use sensor is mounted on or within the handle or grip of the dumbbell. Additionally or alternatively the in-use sensor 66 may be the receiver assembly 16, itself. Reception of the signal by the receiver assembly may require line of sight transmission, which may be blocked by the user's hand gripping the grip 22 of the exercise equipment.

The receiver assembly 14 is powered by a power unit 26, preferably a battery pack also mounted with the receiver assembly within the grip 22 of the dumbbell 12. In one embodiment of the invention, the power unit is at least one battery, and preferably three C-type batteries. The batteries may be disposable or preferably rechargeable, as described further below. Those skilled in the art will recognize that many different power systems are appropriate for the power unit 26 including, but not limited to, button-type batteries, solar power systems, and kinetic energy conversion systems.

The power unit 26 also powers the indicator device 20 mounted to the exercise device. The indicator 20 comprises any suitable device known in the art and preferably provides a sufficient indication of location to a person in the exercise area. Those skilled in the art will recognize that many indicators, including but not limited to lights and audible tones, may be employed to indicate location. Lights suitable for use as indicator 20 are well known in the art and include, but are not limited to, light emitting diodes (LEDs), incandescent lights, and fiber optic cables.

In one embodiment of the invention shown in FIGS. 1A and 1B, indicator 20 is a series of surface mounted light-emitting diodes which may be embedded in a clear plastic sheath. The LED sheath 90 may be mounted around the periphery or along the length of the grip of the weight. Additionally or alternatively, the LED sheath and/or other indicator 20 may be mounted to the inside face 28, outside face 30, and/or the periphery 32 of either or both weights 24. Preferably to simplify electrical connections, the LED sheath is mounted around the periphery of the grip approximately 0.5 inches from the weight 24 inside face. In one embodiment shown in FIGS. 1A and 1B, the indicator is a pair of LED sheaths mounted to each end of the grip approximately 0.5 inches from the inside face of each weight 24. The indicator 20 may be mounted to the exercise equipment using devices known in the art including adhesives, molding, laminations, screws, pins, and tabs.

Preferably, the LED sheath includes at least 6 LEDs, each spaced approximately 60 degrees apart around the circumference of the grip 22. The LEDs may be the same color or preferably, due to the differing voltage requirements for colored LEDs, the LEDs may include red, green, yellow, and/or white LEDs. In one embodiment of the invention, the six LED ring includes in series a red LED, a green LED, a yellow LED, a red LED, a green LED, and a yellow LED pattern. Since red LEDs typically have a lower 'on' voltage than the yellow and green LEDs, it is preferable that the each output pin of the micro-controller 36 not initiate two red LEDs in series. For example as shown in FIG. 4, output pin 1 of the micro-controller 36 may communicate with a red LED R and then a green LED G of a first LED ring and then be connected to ground; output pin 2 of the micro-controller may communicate with a green LED G and then a yellow LED Y of the first LED ring and then be connected to ground; output pin 3 of the micro-controller may communicate with a yellow LED Y, a red LED R of the first LED ring, and then ground; output pin 4 of the micro-controller may communicate with a red LED R, a green LED G of a second LED ring, and ground; output pin 5 of the micro-controller may communicate with a green LED G, a yellow LED Y of the second LED ring, and ground; and output pin 6 may communicate with a yellow LED Y, a red LED R of the second LED ring, and ground.

When initiated, micro-controller 36 may illuminate the LEDs of indicator 20 with a constant illumination, flash the lights, or if two or more LEDs or set of LEDs are used, the LEDs or set of LEDs may alternately flash when initiated. If flashing is used, the flash rate may be substantially equal to 2–3 times per second, although other flash rates may be employed. In one embodiment, the separate LEDs may have different flash rates as well as initiation and termination times to increase awareness by the person trying to locate the exercise equipment as well as maximize the voltage output of the power supply. The flash frequency and/or intensity of the LEDs may increase over the initiation sequence time. The LEDs may have a low intensity at the beginning of the initiation sequence to reduce startling any current user of the exercise equipment and intensity of the LEDs may increase over the initiation sequence. Additionally as shown in the LED initiation timing table of FIG. 8, the flash rate of the LEDs may accelerate over time, preferably the flash frequency may increase to approximately 0.05 Hertz, to increase the urgency and conspicuousness of the exercise equipment.

The micro-controller 36 of the receiver assembly 14 may include a timer 68 to time the initiation sequence to last for a particular period of time after the correct signal has been received. Preferably, the initiation sequence of the indicator 20 will remain initiated for approximately 20 seconds, and if a flashing pattern is used, the pattern may repeat and possibly accelerate and/or increase in intensity for the duration of the 20 seconds. The timer may also deactivate the receiver assembly 14 for a particular period of time after an initiation sequence, which preferably will be until the initiation sequence finishes.

If the power unit 26 for the receiver assembly 14 is rechargeable, the recharging assembly 48 may be a stand-alone system well known in the art of battery recharging to recharge the power unit of each piece of equipment. Preferably, the recharging assembly 48 is integrated into each mount 50 of the storage rack 18 for each piece of equipment 12. In one embodiment of the invention shown in FIG. 1B, the recharging assembly may be a pair of recharging pins, a positive pin 70 and a negative pin 72, at each mount 50, to mate with the positive contact 74 and negative contact 76 on the exercise equipment 12 in communication with the power unit 26 of the equipment. At least one positive and one negative contact will contact its associated recharging pin when the dumbbell is placed in the rack as shown in FIG. 2. The electrical contact allows the recharging assembly to recharge the power unit of the dumbbell.

Preferably, the positive and negative contacts 74, 76 on the piece of exercise equipment is a contact ring around the entire periphery of the exercise equipment, such as the hand grip 22, to ensure that electrical contact is made no matter the rotational position of the exercise equipment in the mount 50. Preferably, each piece of exercise equipment has two pairs of contact rings, one positive and negative pair on each end of the grip 22 of the exercise equipment such that two of the contact rings will make contact with the recharging pins, regardless of the direction that the exercise equipment is placed in the mount 50. Thus, the contact ring pairs are symmetrical about the center of the exercise equipment, as shown in FIG. 1B. In one embodiment, a positive contact ring may be located ¼" from the inside face 28 of each weight 24 and a negative contact ring may be located approximately ⅜" from the inside face 28 of each weight 24. Those skilled in the art will recognize that many arrangements of the recharging pins and/or the contact rings are appropriate for the present invention.

Additionally, the recharging pins 70, 72 may be spring-loaded in the mount 50, such that the recharging pins will only direct and connect an electric current to the contacts 74, 76 when a weight of substantial mass is placed in the mount 50 and depresses the spring-loading of the recharging pin. Thus, users of the system can avoid accidental shock with the electrical connection of the recharging pins.

As discussed above, the exercise equipment 12 may include an in-use sensor 66 to determine when the piece of equipment is in use. The in-use sensor 66 may also indicate how much the exercise equipment is being used. For example, the in-use sensor 66, such as an accelerometer, may differentiate the number of repetitions that the weight is being used and the micro-controller 36 of the receiver assembly 14 may count the repetitions. The counter 54 of the micro-processor may have a reset button (not shown) or alternatively, the counter may reset after some period of time, such as 30 seconds, of "low acceleration" motion. The exercise equipment may have a count indicator device 92 that displays the number of repetitions that the piece of equipment is being put through or preferably indicates the count with a beep or spoken number that announces the count to the user.

Figure 9:
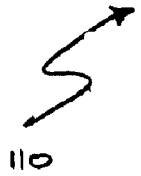
FIG. 9 is a diagram of an exemplary table for a database of equipment us according to one embodiment of the invention.

Additionally as shown in FIG. 4, each piece of exercise equipment may also include a separate transmitter device 52 which transmits a signal to the transmitter assembly 16, which would include a receiver 94, to indicate that the receiver assembly 14 successfully received the transmitted signal 78 as well as successfully initiated the indicator device 20. Furthermore, the transmitter 52 in each dumbbell may transmit the number of repetitions counted by the counter device 54 to the transmitter assembly 16 or to a separate central processor 56. The central processor may log a use history for each piece of exercise equipment in a database 110. FIG. 9 illustrates an example table for a use history database 110, which includes one or more records. In general, each record associates a weight identifier 86 with the use history which may include the number of times used 120, the total number of repetitions 122, and/or the total time used in minutes per day 126. Preferably each record associates the use history for each weight identifier with the date and/or time of use 124, such as a calendar day, thus, the log may show the use of the equipment over a period of one day. Alternatively as shown in FIG. 9, the log may show the use of the equipment over the period of time of each use.

Figure 3:
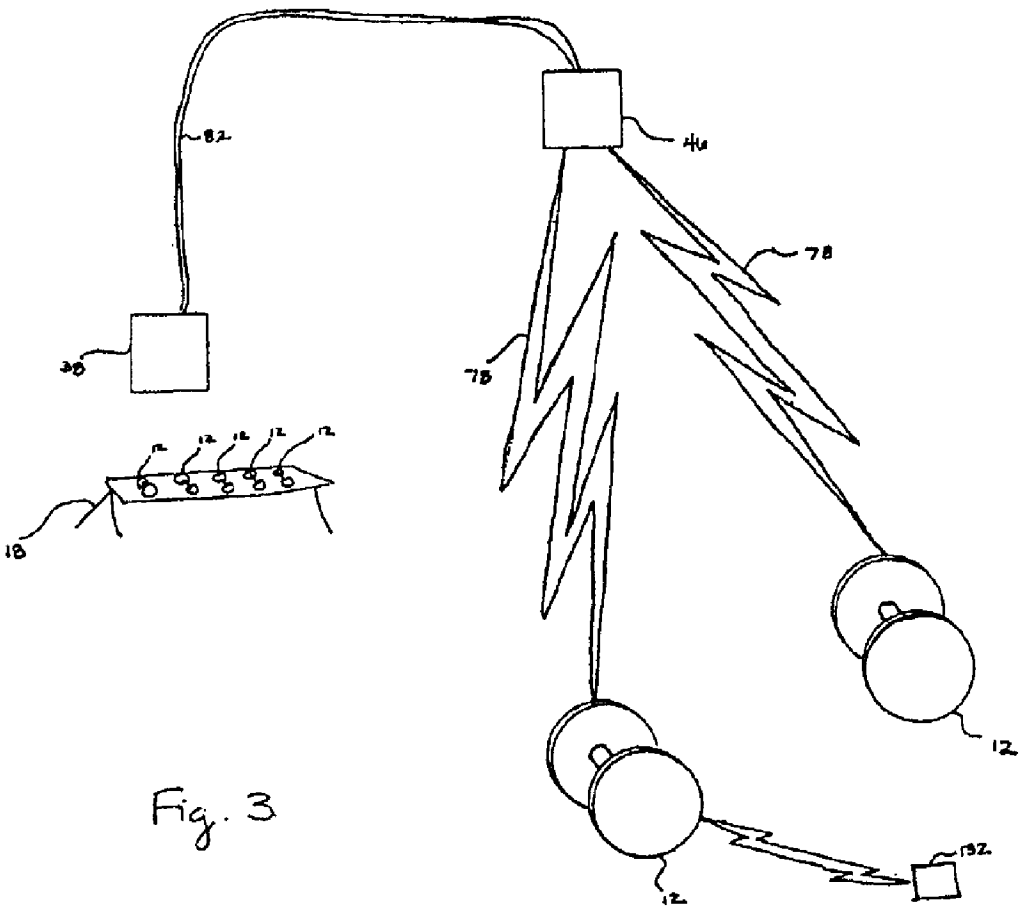
FIG. 3 is a schematic view of an embodiment of the invention.

Additionally or alternatively as shown in FIG. 4, a user may enter an individual user code 112 to associate with the number of repetitions for a particular piece of equipment to log the actual work or exercise history of that user's particular workout over time. The user identifier 112 may be communicated to the piece of exercise equipment through devices known in the art including, but not limited to, magnetic readers, keycards, keypads, fingerprint sensors, or wireless transmitters. As shown in FIGS. 3 and 4, a user could have a wireless identification tag 132 which may be embedded in a workout glove, weight belt, or a separate tag which communicates the individual user code 112 to each piece of exercise equipment which is used by the user, or alternatively, similar to the transmission of repetitions, the identification tag may transmit the user identifier 112 to the receiver assembly 14 and/or central processor 56. Additionally or alternatively, all exercise done may be transmitted to a processor 134 of the identification tag and/or the central processor 56 that may log and compile an exercise report for each person working out identified by the wireless identification tag.

Figure 10:
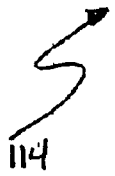
FIG. 10 is a diagram of an exemplary table for a database of a user's use of equipment in one embodiment of the invention.

The central processor may log the user use history for each piece of exercise equipment in a database 114. FIG. 10 illustrates an example table for a user history database 114, which includes one or more records. In general, each record associates a user identifier 112 with the user history which may include the equipment identifier 86, the number of times used 120, total number of repetitions 122, and/or time used 126. Preferably each record also associates the user history for each user with a date and/or time of use 124 or workout identifier 128. Thus, the log may show the use of the equipment for a particular user for each identified workout in a particular day.

Additionally as shown in FIG. 4, a piece of exercise equipment 12 may also include additional in-use sensors 66, such as inclinometers accelerometers, to discern the actual exercise pattern being used by the user. For example, three accelerometers directed in three-dimensional space may detect and determine whether a piece of exercise equipment is being used for a press, a curl, or other type of exercise done with a weight. As discussed above with respect to the counted repetitions, the type of exercise done 130 with a piece of equipment may be logged for a particular piece of equipment in database 110 or for a particular user in database 114.

The log of equipment and/or user use may be viewed, printed, or downloaded by devices known in the art. The central processor 56 may plot the exercise versus time for that individual workout or for multiple workouts over a longer period of time. One or more output devices may be connected to the central processor, which may include cathode ray tube displays, liquid crystal displays, and other video output devices, printers, communication devices such as modem, storage devices such as disk or tape, and audio output.

The micro-controller 36 of the receiver assembly 14, the controller 42 of the transmitter assembly 16, and the processor 134 of the ID tag 132 are typically commercially available processors. The controller 42, the micro-controller 36, and the processor 134 may include the Series IC 86 and Pentium Series Processor, available from Intel, and similar devices from AMD and Cyrix, and the 680X0 Series Microprocessor is available from Motorola, the Power PC Microprocessor from IBM and the Alpha-Series Processors from the former Digital Equipment Corporation, and the MIPS Microprocessor from MIPS Technologies are examples. Many other processors are available. Such a microprocessor executes a program called an operating system, of which Window NT, Windows 95 or 98, IRIX, UNIX, LINUX, DOS, VMS, MacOS, and OS8 are examples, which controls the execution of other computer programs and provide scheduling, debugging, input/output control, accounting, compilation, storage assignment, data management, memory management, and communication control and related services. The processor and operating system define the computer platform for which application programs and high-level programming languages are written.

A memory system typically includes a computer readable and writable non-volatile recording medium, of which a magnetic disk, a flash memory, and tape are examples. The disk may be removable, known as a floppy disk, or permanent, known as a hard drive. A disk has a number of tracks in which signals are stored, typically in binary form, i.e., a form interpreted as a sequence of 1s and 0s. Thus signals may define an application program to be executed by the micro-processor, or information stored on the disk to be processed by the application program. Typically, in operation, the processor causes data to be read from the non-volatile recording medium into an integrated circuit memory element, which is typically a volatile, random access memory, such as a dynamic random access memory (DRAM) or static memory (SRAM). The integrated circuit memory element allows for faster access to the information by the processor than does the disk. The processor generally manipulates the data within the integrated circuit memory and then copies the data to the disk after processing is completed. A variety of mechanisms are known for managing data movement between the disk and the integrated circuit memory element, and the invention is not limited thereto. The invention is not limited to a particular memory system.

Such a system may be implemented in software, hardware, or firmware, or any combination thereof. The various elements of this system, either individually or in combination, may be implemented as a computer program product tangibly embodied in the machine-readable storage device for execution by a computer processor. Various steps of the process may be performed by a computer processor executing the program tangibly embodied on a computer-readable medium to perform functions by operating on input and generating output. Computer programming languages suitable for implementing such a system include procedural programming languages, object-oriented programming languages, and combinations of the two.

The invention is not limited to a particular computer platform, particular processor, or particular high-level programming language. Additionally, the computer system may be a multi-processor computer system or may include multiple computers connected over a computer network.

Having now described a few embodiments, it should be apparent to those skilled in the art that the foregoing is merely illustrative and not limiting, having been presented by way of example only. Numerous modifications and other embodiments may be made.

What is claimed is:

1. A system for tracking exercise completed by a user, comprising:

a. a portable piece of exercise equipment;

b. a device adapted to communicate a unique identification signal, the identification signal correlated to a particular user of the exercise equipment;

c. an in-use sensor mounted to each portable piece of equipment, the in-use sensor having an output; and d. a controller mounted to each portable piece of equipment and responsive to the identification signal and the output of the in-use sensor, wherein the controller is adapted to record the use of the exercise equipment associated with the user identification signal and discern an exercise pattern of the portable piece of equipment being used by the user.

2. The system of claim 1, wherein the in-use sensor comprises an accelerometer.

3. The system of claim 1, wherein the in-use sensor comprises multiple accelerometers.

4. The system of claim 1, wherein the in-use sensor comprises accelerometers adapted to sense acceleration along different axes.

5. The system of claim 1, wherein the in-use sensor comprises an inclinometer.

6. The system of claim 1, wherein the in-use sensor comprises a position sensor.

7. The system of claim 1, wherein the in-use sensor comprises a contact sensor.

8. The system of claim 1, wherein the portable piece of exercise equipment comprises a hand-held weight.

9. The system of claim 1, wherein the controller stores the type of exercise done in a storage device.

10. The system of claim 9, wherein the controller stores the type of exercise correlated with a particular user.

11. The system of claim 1, wherein the controller is responsive to the output of the in-use sensor such that a counter of the controller counts the repetitions of the use of the portable piece of exercise equipment.

12. The system of claim 11, further comprising:

a re-set button in communication with the counter.

13. The system of claim 11, further comprising:

a count indicator device.

14. The system of claim 11, further comprising:

a count transmitter adapted to transmit the number of repetitions to a central processor.

15. The system of claim 14, wherein the number of repetitions transmitted to the central processor is stored in a database of equipment use in a storage medium.

16. The system of claim 15, wherein the central processor associates the unique user identification signal with each stored count of the portable piece of exercise equipment.

17. The system of claim 1, further comprising:

a wireless tag adapted to communicate the unique user identification signal.

18. The system of claim 17, wherein the wireless tag is embedded in a workout glove.

19. The system of claim 17, wherein the wireless tag is embedded in a weight belt.

20. The system of claim 1, further comprising:

e. an indicator mounted to the portable piece of exercise equipment;

f. a transmitter adapted to send an actuation signal and remotely located from the portable piece of exercise equipment;

g. a receiver assembly mounted to the portable piece of exercise equipment, the receiver assembly responsive to the actuation signal and having receiver output;

wherein the controller is responsive to the receiver output of the receiver assembly such that the indicator is initiated when the receiver assembly receives the actuation signal.

21. The system of claim 20, wherein the indicator includes a light.

22. The system of claim 21, wherein the light includes at least one light emitting diode.

23. The system of claim 22, wherein the at least one light emitting diode includes a plurality of light emitting diodes mounted within a clear sheath, the sheath mounted to a surface of the exercise device.

24. The system of claim 23, wherein the sheath is mounted to a hand grip of the exercise device.

25. The system of claim 21, wherein the indicator remains initiated for a predetermined period of time after the indicator is initiated.

26. The system of claim 25, wherein the light, having an intensity, is initiated to have a low intensity, the intensity increasing over the predetermined period of time.

27. The system of claim 25, wherein the controller deactivates the receiver assembly while the indicator is initiated.

28. The system of claim 1, further comprising:

a power unit mounted to the portable piece of exercise equipment and electrically coupled to the in-use sensor and the controller.

29. The system of claim 28, wherein the power unit is at least one battery.

30. The system of claim 29, wherein the at least one battery is rechargeable.

31. The system of claim 30, wherein the power unit further comprises at least one contact ring mounted to a periphery of the portable piece of exercise equipment and adapted to contact a recharging unit.

32. The system of claim 31, further comprising:

a storage rack having a storage mount for storing the portable piece of exercise equipment, wherein the recharging unit is mounted to the storage rack in the storage mount.

33. The system of claim 32, wherein the at least one contact ring includes two pairs of contact rings, each pair of contact rings including a positive contact ring and a negative contact ring, each pair of contact rings being symmetrically mounted on opposite sides of the portable piece of exercise equipment, the recharging unit adapted to contact only one positive and negative contact ring pair at a time.

34. The system of claim 31, wherein the recharging unit includes a spring mounted positive contact and a spring mounted negative contact adapted to electrically communicate with the rechargeable power unit when the spring mount is depressed by a determined mass weight.

35. The system of claim 1, wherein the portable piece of exercise equipment is a plurality of pieces of exercise equipment and the output signal also comprises a unique identifier correlated to an individual portable piece of exercise equipment within the plurality of pieces of exercise equipment.

36. The system of claim 1, wherein the exercise pattern is a curl.

37. The system of claim 1, wherein the exercise pattern is a press.

38. The system of claim 1, wherein the controller is adapted to discern multiple exercise patterns.

39. The system of claim 38, wherein the multiple exercise patterns include curls and presses.

40. A method of tracking exercise completed by a user, the method comprising:

communicating a unique identification signal to a controller, the identification signal correlated to a particular user of a portable piece of exercise equipment;

communicating an output from an in-use sensor mounted to the portable piece of equipment to the controller;

recording with the controller the use of the exercise equipment associated with the user identification signal; and discerning with the controller an exercise pattern of the portable piece of equipment being used by the user.

41. The method of claim 40, further comprising:

storing the type of exercise done in a storage device.

42. The method of claim 41, wherein the controller stores the type of exercise correlated with a particular user.

43. The method of claim 40, further comprising:

counting repetitions of the use of the portable piece of exercise equipment.

44. The method of claim 40, wherein the unique user identification signal is communicated from a tag worn by the user.

45. The method of claim 40, further comprising:

transmitting an actuation signal to the portable piece of exercise equipment from a remote location;

receiving the actuation signal with a receiver assembly mounted to the portable piece of exercise equipment; and outputting an output signal with an indicator mounted on the portable piece of exercise equipment.

46. The method of claim 40, wherein discerning an exercise pattern comprises discerning an exercise pattern associated with a press.

47. The method of claim 40, wherein discerning an exercise pattern comprises discerning an exercise pattern associated with a curl.

* * * * *